US009986330B2

(12) United States Patent
Roh et al.

(10) Patent No.: US 9,986,330 B2
(45) Date of Patent: May 29, 2018

(54) AUDIO DEVICE INCLUDING JACK DETECTOR

(71) Applicant: SAMSUNG ELECTRONICS CO., LTD., Suwon-si, Gyeonggi-Do (KR)

(72) Inventors: Hyungdong Roh, Yongin-si (KR); Jaekeun Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days. days.

(21) Appl. No.: 15/586,308

(22) Filed: May 4, 2017

(65) Prior Publication Data

US 2018/0014116 A1 Jan. 11, 2018

(30) Foreign Application Priority Data

Jul. 6, 2016 (KR) ..... 10-2016-0085604

(51) Int. Cl.
*H04R 29/00* (2006.01)
*H04R 3/00* (2006.01)
*H04R 1/10* (2006.01)

(52) U.S. Cl.
CPC ..... *H04R 3/00* (2013.01); *H04R 29/00* (2013.01); *H04R 1/1041* (2013.01); *H04R 29/001* (2013.01); *H04R 2420/05* (2013.01)

(58) Field of Classification Search
CPC ..... H04R 1/1041; H04R 5/04; H04R 29/001; H04R 29/00
USPC ..... 381/74, 58, 77
See application file for complete search history.

(56) References Cited

U.S. PATENT DOCUMENTS

| | | | | |
|---|---|---|---|---|
| 9,389,264 | B2 * | 7/2016 | Seo | H01R 24/58 |
| 2013/0293240 | A1 | 11/2013 | Seo et al. | |
| 2014/0225632 | A1 | 8/2014 | Oh et al. | |
| 2014/0301562 | A1 * | 10/2014 | Tu | H04R 3/00 381/74 |
| 2015/0117663 | A1 * | 4/2015 | Hsu | H04R 1/1041 381/74 |
| 2015/0208154 | A1 | 7/2015 | Turner | |

FOREIGN PATENT DOCUMENTS

| | | | |
|---|---|---|---|
| JP | H11136784 | A | 5/1999 |
| JP | 2014107757 | A | 6/2014 |
| KR | 1020040044794 | A | 5/2004 |
| KR | 1020050032755 | A | 4/2005 |

* cited by examiner

*Primary Examiner* — Disler Paul
(74) *Attorney, Agent, or Firm* — Volentine, Whitt & Francos, PLLC

(57) ABSTRACT

An audio device includes a channel detection electrode and a jack detector configured to determine whether the channel detection electrode is in contact with a jack according to voltage variation of a detection node. The jack detector includes a first resistor coupled between the detection node and a first node to which a first voltage is supplied, a second resistor coupled between the detection node and the channel detection electrode, a third resistor coupled between the detection node and a second node, and a comparator configured to compare a voltage at the detection node with a reference voltage.

17 Claims, 13 Drawing Sheets

AUDIO DEVICE INCLUDING JACK DETECTOR

CROSS-REFERENCE TO RELATED APPLICATION

A claim for priority under 35 U.S.C. § 119 is made to Korean Patent Application No. 10-2016-0085604, filed on Jul. 6, 2016, the disclosure of which is incorporated herein in its entirety by reference.

BACKGROUND

The inventive concepts herein relate generally to electronic devices and, more particularly, to an audio device including a jack detector.

Multimedia devices such as smartphones or smart pads are typically configured to generate (e.g., generate to record) and play video data and audio data. Audio data may be reproduced through a speaker to be heard concurrently by multiple people for example, or may be reproduced through a personal reproducing device such as earphones or headphones to be heard by a single person. Multimedia devices are configured to reproduce audio data through a speaker when a personal reproducing device is disconnected therefrom, and to reproduce audio data through a personal reproducing device when the personal reproducing device is connected thereto. To achieve this function, multimedia devices include a jack detector to detect whether a jack of a personal reproducing device is inserted into a jack slot of the multimedia device.

When a jack detector detects connection of a jack with a jack slot of the multimedia device, an audio codec transmits a channel signal to the jack to reproduce sound. However, while the audio codec transmits the channel signal to the jack, an error may often occur whereby the jack detector may for example mistake the jack as being disconnected from the jack slot of the multimedia device. In such an instance where the jack detector mistakenly detects the jack as disconnected from the jack slot of the multimedia device, the audio codec will stop transmitting the channel signal. That is, sound heard by a user through headphones or earphones may be turned off.

SUMMARY

Embodiments of the inventive concept relate to an audio device including a jack detector that prevents a jack from being mistakenly detected as being disconnected from the audio device.

Embodiments of the inventive concept provide an audio device including a channel detection electrode and a jack detector. The jack detector is configured to determine whether the channel detection electrode is in contact with a jack according to a voltage variation at a detection node. The jack detector includes a first resistor coupled between the detection node and a first node to which a first voltage is supplied, a second resistor coupled between the detection node and the channel detection electrode, a third resistor coupled between the detection node and a second node, and a comparator configured to compare a voltage at the detection node with a reference voltage.

Embodiments of the inventive concept provide an audio device including an audio codec circuit and a jack detector. The audio codec is connected to a first channel electrode and a second channel electrode. The jack detector is connected to a first channel detection electrode and a ground detection electrode. The jack detector is configured to determine whether the first channel detection electrode is in contact with a jack according to a voltage variation of a detection node. The jack detector includes a first resistor coupled between the detection node and a first node to which a first voltage is supplied, a second resistor coupled between the detection node and the first channel detection electrode, a third resistor coupled between the detection node and a second node, and a comparator configured to compare a voltage at the detection node with a reference voltage.

Embodiments of the inventive concept also provide an audio device including a jack slot and a jack detector. The jack slot includes a channel detection electrode. The jack detector is configured to determine whether the jack is inserted into the jack slot. The jack detector is configured to provide a detection voltage at a detection node responsive to a power supply voltage, a negative voltage and a voltage at the channel detection electrode, a level of the detection voltage is lower than a predetermined fraction of a level of the power supply voltage. The jack detector includes a comparator configured to compare the detection voltage with a reference voltage and to provide an output signal indicative of whether the jack is inserted into the jack slot responsive to the comparison.

BRIEF DESCRIPTION OF THE DRAWINGS

The forgoing and other features of inventive concepts will be described below in more detail with reference to the accompanying drawings in which like reference characters refer to like parts throughout the different views. The drawings are not necessarily to scale, emphasis instead being placed upon illustrating principles of inventive concepts. In the drawings.

DETAILED DESCRIPTION

As is traditional in the field of the inventive concepts, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the inventive concepts. Likewise, the blocks of the embodiments may be physically combined into more complex blocks without departing from the scope of the inventive concepts.

Figure 1:
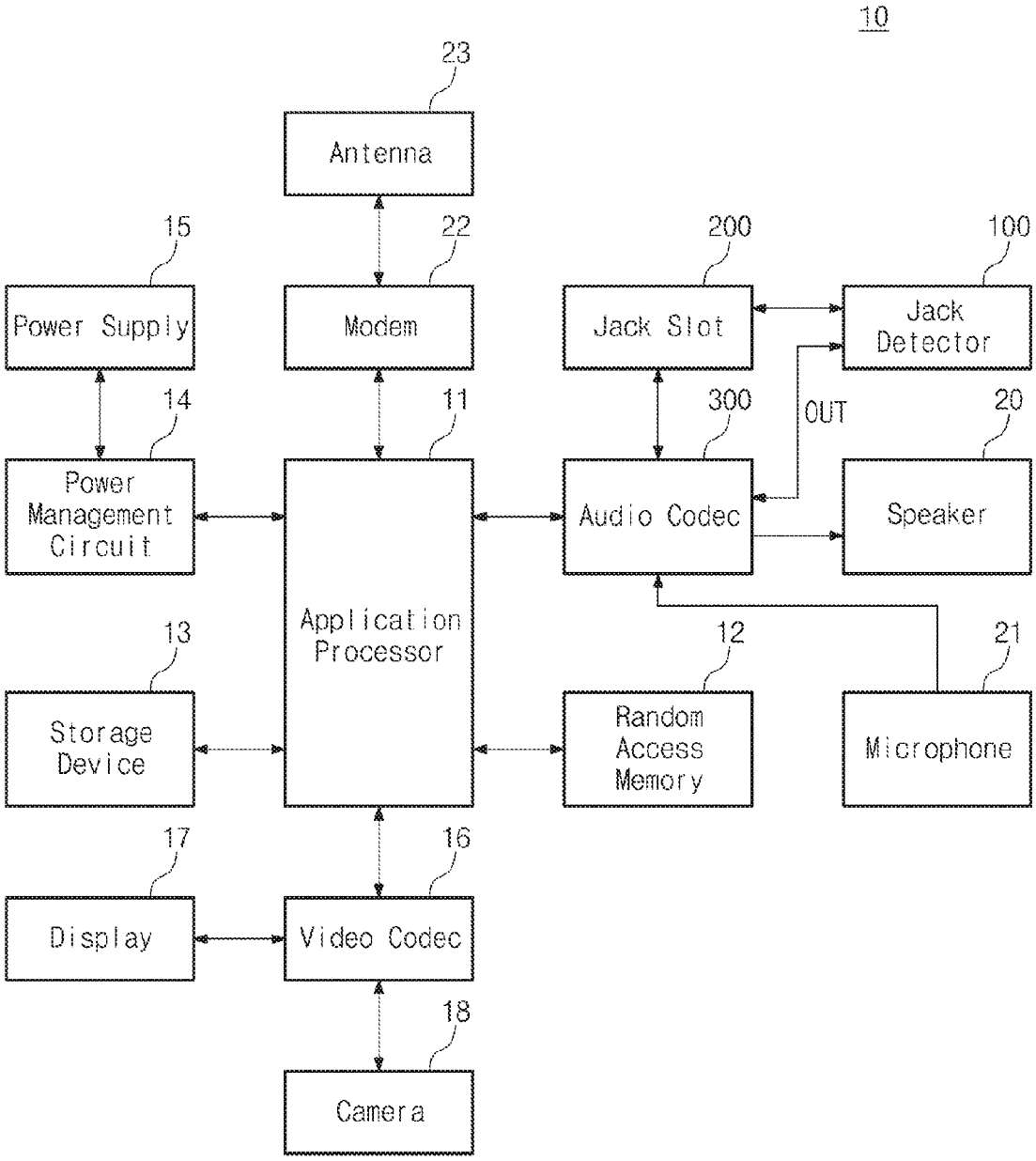
FIG. 1 illustrates a block diagram of a multimedia device according to embodiments of inventive concept.

FIG. 1 illustrates a block diagram of a multimedia device 10 according to embodiments of inventive concept. For example, the multimedia device 10 may form at least one of a smartphone, a smart pad, a smart TV, a smart watch or a wearable device. Referring to FIG. 1, the multimedia device 10 includes an application processor 11, a random access memory 12, a storage device 13, a power management circuit 14, a power supply 15, a video codec 16, a display 17, a camera 18, an audio codec 300, a speaker 20, a microphone 21, a modem 22, an antenna 23, a jack detector 100, and a jack slot 200.

The application processor 11 may perform a control operation to control the multimedia device 10 and a processing operation to process various data. The application processor 11 may execute an operating system (OS) and various applications.

The random access memory 12 may be used as a main memory device of the application processor 11. For example, the random access memory 12 may store various data and process codes processed by the application processor 11. The random access memory 12 may include for example a dynamic RAM (DRAM), a static RAM (SRAM), a phase-change RAM (PRAM), a magnetic RAM (MRAM), a ferroelectric RAM (FRAM), a resistive RAM (RRAM) or the like.

The storage device 13 may be used as an auxiliary memory device of the application processor 11. For example, an operating system (OS) or source codes of various applications executed by the application processor 11 or various data generated for the purpose of being stored for a long period of time by the OS or the applications may be stored in the storage device 13. The storage device 13 may include for example a flash memory, a phase-change RAM (PRAM), a magnetic RAM (MRAM), a ferroelectric RAM (FeRAM), a resistive RAM (RRAM) or the like.

The power management circuit 14 may distribute or supply power supplied from the power supply 15 to components of the multimedia device 10. The power management circuit 14 may adjust the amount of the power distributed or supplied to the components of the multimedia device 10 according to a state of the multimedia device 10 or the amount of a work performed by the multimedia device 10. For example, the power management circuit 14 may control a power saving mode of the multimedia device 10 or each of the components of the multimedia device 10.

The power supply 15 may include a power supply mounted on an artificial architecture such as building or a portable battery.

The video codec 16 may generate or reproduce video data. For example, the video codec 16 may encode data obtained by the camera 18 to generate the video data. The video codec 16 may decode video data generated by the camera 18 or video data stored in the storage device 13 or the random access memory 12 to reproduce the video data on the display 17. For example, the display 17 may include a liquid crystal display (LCD), an organic light emitting diode (OLED), an active matrix OLED (AMOLED), a flexible display, an electronic ink (e-ink) display or the like.

The audio codec 300 may generate or store audio data. For example, the audio codec 300 may encode a signal obtained by the microphone 21 to generate audio data. The audio codec 300 may decode audio data generated by the microphone 21 or audio data stored in the storage device 13 or the random access memory 12 to reproduce the audio data through the speaker 20.

The audio codec 300 is connected to the jack detector 100 and the jack slot 200. The jack detector 100 may detect whether an external personal reproducing device is inserted into the jack slot 200 and may provide a detection result to the audio codec 300 as an output signal OUT. When the external personal reproducing device is inserted into the jack slot 200, the audio codec 300 may reproduce the audio data through the personal reproducing device.

The jack detector 100 may detect whether a jack of the personal reproducing device is inserted into the jack slot 200. For example, the personal reproducing device may include for example headphones, earphones, a virtual reality device or the like. Additionally, the jack detector 100 may detect whether an inserted external personal reproducing device includes microphones. If the external personal reproducing device includes microphones, the audio codec 300 may generate audio data based on the data obtained from the microphones of the external personal reproducing device.

In some embodiments of the inventive concept, the audio codec 300 and the jack detector 100 may be implemented as a single semiconductor package. For example, the jack detector 100 may be incorporated in the audio codec 300.

The modem 22 may communicate with an external device through the antenna 23. For example, the modem 22 may perform communications based on one or more of a plurality of wireless communication techniques or protocols including, for example, Long Term Evolution (LTE), WiMax, Global System for Mobile communication (GSM), Code Division Multiple Access (CDMA), Bluetooth, Near Field Communication (NFC), WiFi, and Radio Frequency Identification (RFID), or the like, and/or one or more of a plurality of wired communication techniques or protocols including, for example, Universal Serial Bus (USB), Serial AT Attachment (SATA), Small Computer Small Interface (SCSI), Firewire, Peripheral Component Interconnection (PCI), PCI express (PCIe), NonVolatile Memory express (NVMe), Universal Flash Storage (UFS), Secure Digital (SD), SDIO, Universal Asynchronous Receiver Transmitter (UART), Serial Peripheral Interface (SPI), High Speed SPI (HS-SPI), RS232, Inter-integrated Circuit (I2C), HS-I2C, Integrated-interchip Sound (I2S), Sony/Philips Digital Interface (S/PDIF), MultiMedia Card (MMC), and embedded MMC (eMMC), or the like.

Figure 2:
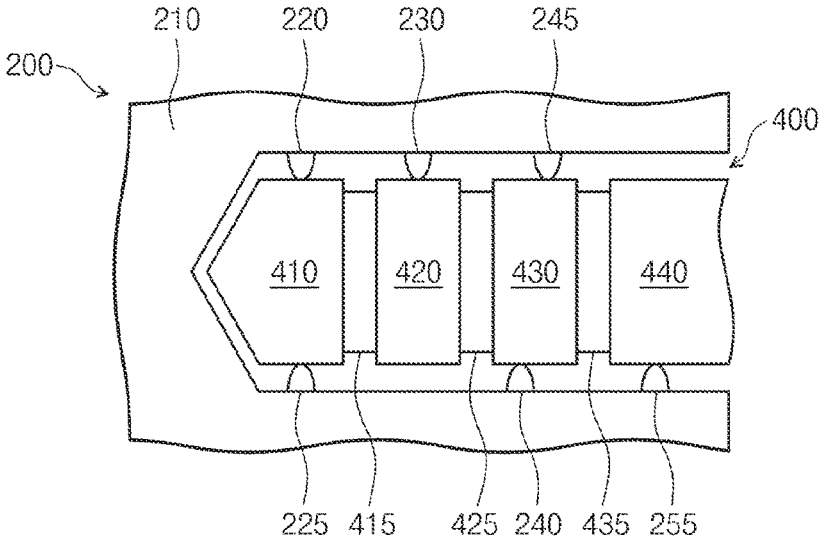
FIG. 2 illustrates an example in which a jack of an external personal reproducing device is inserted into a jack slot.

FIG. 2 illustrates an example in which a jack 400 of an external personal reproducing device is inserted into a jack slot 200. For example, a 4-pole jack 400 inserted into the jack slot 200 is shown in FIG. 2.

Referring to FIGS. 1 and 2, the jack slot 200 includes a body 210, a first channel electrode 220, a second channel electrode 230, a ground electrode 240, a first channel detection electrode 225, a ground detection electrode 245, and a microphone detection electrode 255. The body 210 may be a case, a mold or a frame of the multimedia device 10.

The first channel electrode 220 and the second channel electrode 230 are connected to the audio codec 300. When the jack 400 is not coupled with the jack slot 200, the audio codec 300 may apply a power supply voltage to the first channel electrode 220 and the second channel electrode 230. When the jack 400 is coupled with the jack slot 200, the audio codec 300 may transmit channel signals for playing sound to the first channel 220 and the second channel 230, respectively.

The ground electrode 240 may be connected to the jack detector 100 or the audio codec 300, and may be connected to a ground node of the jack detector 100 or the audio codec 300. The ground node may be a node to which a ground voltage is supplied.

The first channel detection electrode 225 and the ground detection electrode 245 may be connected to the jack detector 100. The jack detector 100 may detect whether the jack 400 is coupled with the jack slot 200, based on voltages of the first channel detection electrode 225 and the ground detection electrode 245.

The microphone detection electrode 255 is connected to the jack detector 100 and the audio codec 300. When the jack 400 is not coupled with the jack slot 200, the jack detector 100 may transmit a ground voltage to the microphone detection electrode 255. When it is detected that the jack 400 is inserted into the jack slot 200, the jack detector 100 may apply a bias voltage to the microphone detection electrode 255 to detect whether the personal reproducing device inserted into the jack slot 200 includes a microphone. If the personal reproducing device inserted into the jack slot 200 does not include a microphone, the jack detector 100 may apply a ground voltage to the microphone detection electrode 255. If the personal reproducing device inserted into the jack slot 200 includes a microphone, the jack detector 100 may continue to apply a bias voltage to the microphone detection electrode 255. The audio codec 300 may obtain audio data based on voltage variation of the microphone detection electrode 255.

In some embodiments of the inventive concept, the jack 400 inserted into the jack slot 200 may include four poles. A first pole 410 may receive an audio signal of a first channel, e.g., a signal of a left channel from the first channel electrode 220. A second pole 420 may receive an audio signal of a second channel, e.g., a signal of a right channel from the second channel electrode 230. A third pole 430 may receive a ground voltage from the ground electrode 240. A fourth pole 440 may transmit an audio signal to the audio codec 300 through the microphone detection electrode 255.

The first pole 410 and the second pole 420 may be electrically insulated from each other by a first insulator 415. The second pole 420 and the third pole 430 may be electrically insulated from each other by a second insulator 425. The third pole 430 and the fourth pole 440 may be electrically insulated from each other by a third insulator 435.

Figure 3:
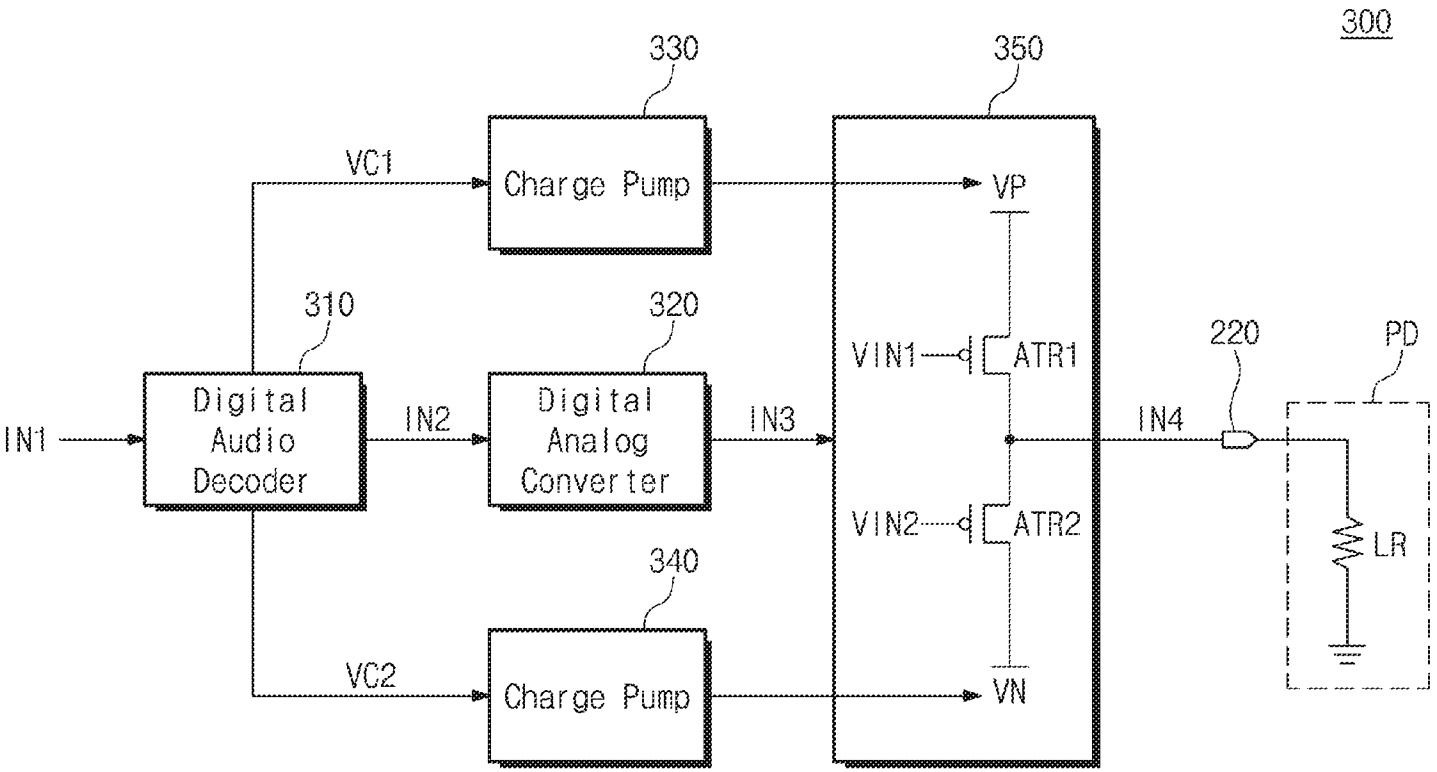
FIG. 3 illustrates a block diagram of an audio codec according to embodiments of inventive concept.

FIG. 3 illustrates a block diagram of an audio codec 300 according to embodiments of inventive concept. For example, a portion of the codec 300 that supplies a channel signal to the first pole 410 of the jack 400 is shown in FIG. 3.

Referring to FIGS. 1 and 3, the audio codec 300 includes a digital audio decoder 310, a digital-analog converter 320, first and second charge pumps 330 and 340, and an amplifier 350.

The digital audio decoder 310 may receive a first input signal IN1 from an external device. The first input signal IN1 may be a digital audio signal that will be used to reproduce sound of a first channel. The first input signal IN1 may be transmitted from the application processor 11 or the microphone 21. The digital audio decoder 310 may decode the first input signal IN1 and may output the decoded first input signal IN1 as a second input signal IN2. The second input signal IN2 is transmitted to the digital-analog converter 320. The digital audio decoder 310 may generate first and second voltage control signals VC1 and VC2 based on the first input signal IN1. The first and second voltage control signals VC1 and VC2 are transmitted to the first and second charge pumps 330 and 340, respectively.

In some embodiments of the inventive concept, the first and second voltage control signals VC1 and VC2 may include information on swing width of the first input signal IN1. For example, the first and second voltage control signals VC1 and VC2 may include information on target levels of voltages respectively generated by the first and second charge pumps 330 and 340. The target levels are associated with the swing width of the first input signal IN1. For example, a target level of the first charge pump 330 may be higher than or equal to a maximum level of the first input signal IN1 and a target level of the second charge pump 340 may be lower than or equal to a minimum level of the second input signal IN2. In some embodiments of the inventive concept, the target levels may be predicted levels that are predicted based on a previous waveform of the first input signal IN1. The target levels may be decided by adding a margin to the predicted levels. In other embodiments of the inventive concept, the target levels may be actually measured levels that are measured based on a current waveform of the first input signal IN1. The target levels may be decided by adding a margin to the actually measured levels.

The digital-analog converter 320 may receive the second input signal IN2 from the digital audio decoder 310. The digital-analog converter 320 may convert the second input signal IN2 that is a digital signal, into a third input signal IN3 that is an analog signal. The third input signal IN3 may be transmitted to the amplifier 350 as an input that is an amplification target.

The first charge pump 330 may output a positive voltage VP according to the first voltage control signal VC1. For example, the first charge pump 330 may adjust a level of the positive voltage VP in real time under the control of the first voltage control signal VC1. The positive voltage VP may be transmitted to the amplifier 350 as a positive bias voltage.

The second charge pump 340 may output a negative voltage VN according to the second voltage control signal VC2. For example, the second charge pump 340 may adjust a level of the negative voltage VN in real time under the control of the second voltage control signal VC2. The negative voltage VN may be transmitted to the amplifier 350 as a negative bias voltage.

The amplifier 350 includes first and second amplifier transistors ATR1 and ATR2. The first and second amplifier transistors ATR1 and ATR2 are serially coupled between a node to which the positive voltage VP is supplied and a node to which the negative voltage VN is supplied. A third input signal IN3 may be transmitted to a gate of at least one of the first and second amplifier transistors ATR1 and ATR2. In some embodiments of the inventive concept, the third input signal IN3 may be transmitted to a gate of one of the first and second amplifier transistors ATR1 and ATR2, and a fixed voltage may be supplied to a gate of the other transistor of the first and second amplifier transistors ATR1 and ATR2. The fixed voltage may turn on a corresponding transistor. In other embodiments of the inventive concept, the third input signal IN3 may be transmitted to a gate of one of the first and second amplifier transistors ATR1 and ATR2, and an inverted version of the input signal IN3 may be transmitted to a gate of the other transistor of the first and second amplifier transistors ATR1 and ATR2. A voltage at a node between the first and second amplifier transistors ATR1 and ATR2 may be transmitted to the first channel electrode 220 as a fourth input signal IN4. In an embodiment of the inventive concept, the first and second amplifier transistors ATR1 and ATR2 may be implemented as same type transistors (e.g., either both as P-type transistors as shown, or both as N-type transistors). In other embodiments, the first and second amplifier transistors ATR1 and ATR2 may be implemented as respective different type transistors. For example, the first amplifier transistor ATR1 may be a P-type transistor and the second amplifier transistor ATR2 may be an N-type transistor. As another example, the first amplifier transistor ATR1 may be an N-type transistor and the second amplifier transistor may be a P-type transistor.

The fourth input signal IN4 at the first channel electrode 220 may be transmitted to a personal reproducing device PD through the first pole 410 of the jack 400. In FIG. 3, the personal reproduction device PD may be modeled with a load resistor LR. In some embodiments of the inventive concept, the load resistor LR may have a very low resistance, e.g., 32 ohms.

In some embodiments of the inventive concept, the audio codec 300 may receive an output signal OUT from the jack detector 100 (see FIG. 5) that indicates whether the jack 400 is inserted into the jack slot 200. More specifically, the output signal OUT may indicate whether the first pole 410 and the third pole 430 of the jack 400 are respectively in contact with the first channel detection electrode 225 and the ground detection electrode 245 as shown in FIG. 2. When the output signal OUT indicates that the jack 400 is inserted, a positive voltage VP having a positive level and a negative voltage VN having a negative level may be supplied to the amplifier 350. When the output signal OUT indicates that the jack 400 is not inserted, the positive voltage VP and the negative voltage VN may be floated. For example, the first and second charge pumps 330 and 340 may respectively stop generating or outputting the positive voltage VP and the negative voltage VN. For example, switches (not shown) may be arranged between the first and second charge pumps 330 and 340 and the amplifier 350, and the switches may be turned off responsive to the output signal OUT indicating that the jack 400 is not inserted. In the case where the switches are turned off, the respective nodes of the amplifier 350 to which the positive voltages VP and the negative voltage VN are supplied may for example be instead floated.

As noted above, a portion of the audio codec 300 of a first channel corresponding to the first pole 410 has been described with reference to FIG. 3. A portion of the audio codec 300 of a second channel corresponding to the second pole 420 may have the same configuration as that described with reference to FIG. 3 and may operate the same as described with reference to FIG. 3. Detailed description of a portion of the audio codec 300 of a second channel corresponding to the second pole 420 and operation thereof are thus omitted. At least some of components of a first portion of the audio codec 300 corresponding to the first channel and components of a second portion of the audio codec 300 corresponding to the second channel may be commonly used in the first portion and the second portion.

Figure 4:
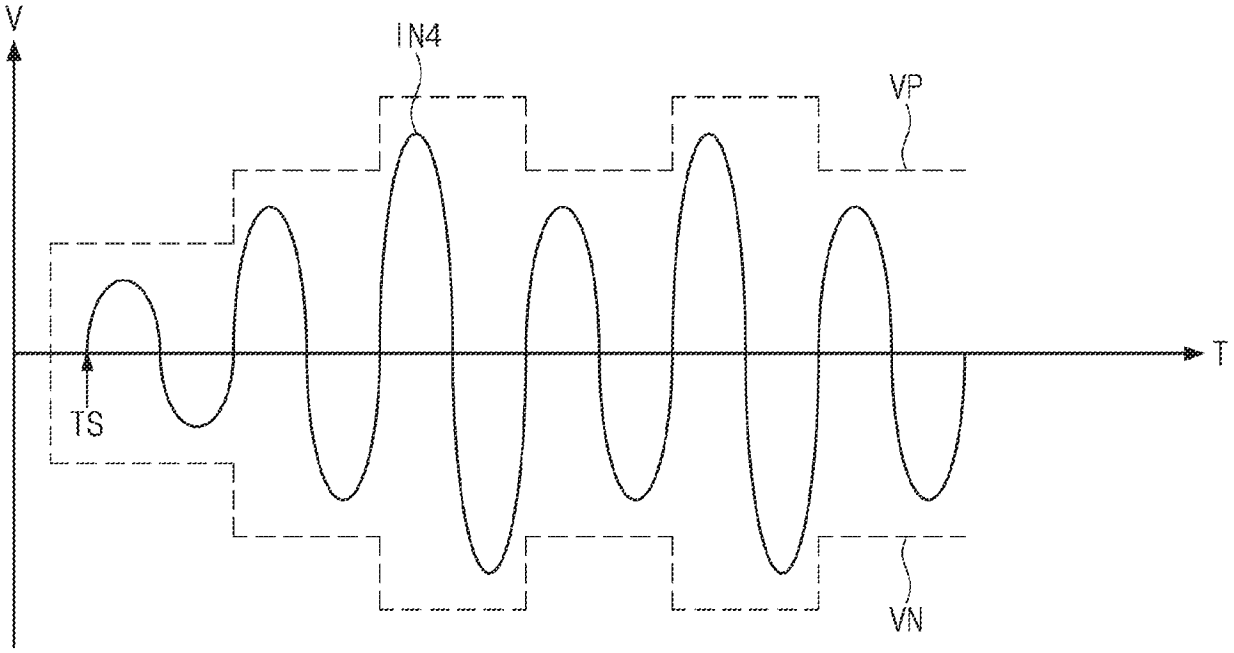
FIG. 4 illustrates examples of signals generated or output from an audio codec.

FIG. 4 illustrates examples of signals generated or output from the audio codec 300. The generated or output signals in this instance may for be example provided to the first channel electrode 220 within jack slot 200. In FIG. 4, a horizontal axis denotes time T and a vertical axis denotes a voltage V. Referring to FIGS. 3 and 4, a positive voltage VP, a negative voltage VN, and a fourth input signal IN4 are shown. Audio starts to be played from a start time TS. The first and second charge pumps 330 and 340 may respectively increase a level of the positive voltage VP and decrease a level of the negative voltage VN prior to start time TS. However, in other embodiments the first and second charge pumps 330 and 340 may respectively increase the level of the positive voltage VP and decrease the level of the negative voltage VN at the start time TS.

When swing width of the fourth input signal IN4 increases, the first charge pump 330 may further increase the level of the positive voltage VP and the second charge pump 340 may further decrease the level of the negative voltage VN. When the swing width of the fourth input signal IN4 decreases, the first charge pump 330 may decrease the level of the positive voltage VP and the second charge pump 340 may increase the level of the negative voltage VN. The first charge pump 330 may generate the positive voltage VP such that the level of the positive voltage VP is higher than a maximum level of the fourth input signal IN4. The second charge pump 340 may generate the negative voltage VN such that the level of the negative voltage VN is lower than a minimum level of the fourth input signal IN4.

Figure 5:
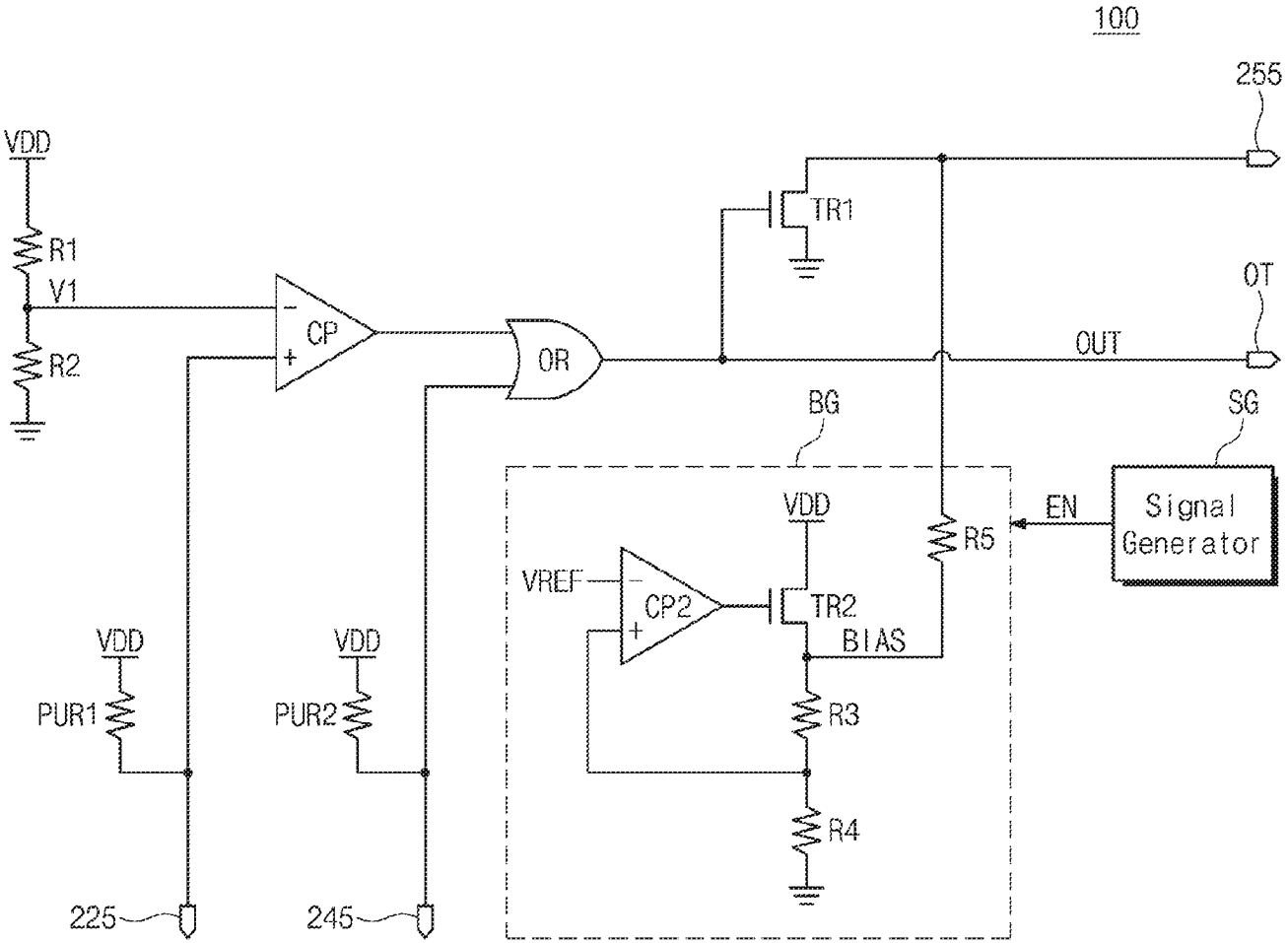
FIG. 5 illustrates a circuit diagram of a jack detector according to embodiments of inventive concept.

FIG. 5 illustrates a circuit diagram of a jack detector 100 according to embodiments of inventive concept. Referring to FIGS. 1 and 5, the jack detector 100 includes a first resistor R1, a second resistor R2, a comparator CP, a first pull-up resistor PUR1, a logic gate circuit OR, a second pull-up resistor PUR2, a first transistor TR1, a signal generator SG, and a bias voltage generation circuit BG.

The first resistor R1 and the second resistor R2 are serially coupled between a power supply node to which a power supply voltage VDD is supplied and a ground node to which a ground voltage is supplied. A voltage at a node between the first resistor R1 and the second resistor R2 may be a first voltage V1.

The comparator CP is configured to compare the first voltage V1 with a voltage of the first channel detection electrode 225. When the voltage of the first channel detection electrode 225 is higher than or equal to the first voltage V1, the comparator CP may output a high level. When the voltage of the first channel detection circuit 225 is lower than the first voltage V1, the comparator CP may output a low level. An output of the comparator CP is transmitted to the logic gate circuit OR.

The first pull-up resistor PUR1 is coupled between the power supply node and the first channel detection electrode 225. The first pull-up resistor PUR1 may transmit the power supply voltage VDD to the first channel detection electrode 225 such that the voltage of the first channel detection electrode 225 is the power supply voltage when the jack 400 is not inserted into the jack slot 200.

The logic gate circuit OR may perform a logic OR operation based on the output of the comparator CP and the voltage of the ground detection electrode 245. An output of the logic gate circuit OR may be transmitted to the audio codec 300 through an output terminal OT as an output signal OUT. In some embodiments of the inventive concept, when the output signal OUT of the logic gate circuit OR is low, i.e., voltages of the first channel detection electrode 225 and the ground detection electrode 245 are ground voltage or low voltages each having a level similar to that of the ground voltage, it may be determined that the jack 400 is inserted into the jack slot 200. When the output signal OUT of the logic gate circuit OR is high, i.e., at least one of the voltages of the first channel detection electrode 225 and the ground detection electrode 245 is power supply voltage VDD or a positive voltage having a level similar to that of the power supply voltage VDD, it may be determined that the jack 400 is not inserted into the slot 200.

The first transistor TR1 is coupled between the microphone detection electrode 255 and a ground node to which a ground voltage is supplied and operates under the control of the logic gate circuit OR. When the output signal OUT of the logic gate circuit OR is high, i.e., the jack 400 is not inserted into the jack slot 200, the first transistor TR1 connects the ground node with the microphone electrode 255. That is, the ground voltage is supplied to the microphone detection electrode 255. When the output signal OUT of the logic gate circuit OR is low, i.e., the jack 400 is coupled with the jack slot 200, the first transistor TR1 is turned off. That is, the voltage of the microphone detection electrode 255 is controlled by the bias voltage generation circuit BG.

The signal generator SG outputs an enable signal EN. For example, when the output signal OUT of the logic gate circuit OR is high, i.e., the jack 400 is not coupled with the jack slot 200, the enable signal EN is disabled. When the output signal of the logic gate circuit OR is low, i.e., the audio codec 300 or the jack 400 is coupled with the jack slot 200, the enable signal EN is enabled.

When the enable signal EN is enabled, the bias voltage generation circuit BG supplies a bias voltage BIAS to the microphone detection electrode 255. When the enable signal EN is disabled, the bias voltage generation circuit BG is disabled and does not output the bias voltage BIAS. For example, the bias voltage generation circuit BG may output a ground voltage.

The bias voltage generation circuit BG includes a second comparator CP2, a second transistor TR2, a third resistor R3, a fourth resistor R4, and a fifth resistor R5.

The third and fourth resistors R3 and R4 are serially coupled between a ground node to which a ground voltage is supplied and the second transistor TR2. A node between the third and fourth resistors R3 and R4 is connected to a positive input of the second comparator CP2. A reference voltage VREF is input to a negative input of the second comparator CP2.

The second transistor TR2 is coupled between the power supply node to which the power supply voltage VDD is supplied and the third resistor R3. The second transistor TR2 is controlled according to an output of the second comparator CP2. A voltage at a node between the second transistor TR2 and the third resistor R3 is the bias voltage BIAS. The bias voltage BIAS is transmitted to the microphone detection electrode 255. The bias voltage generation circuit BG may adjust the bias voltage BIAS using the second transistor TR2 according to the output of the second comparator CP2 so that a voltage at a node between the third and fourth resistors R3 and R4 is made equal to the reference voltage VREF. The microphone 21 may obtain an audio signal using the bias voltage BIAS.

Figure 6:
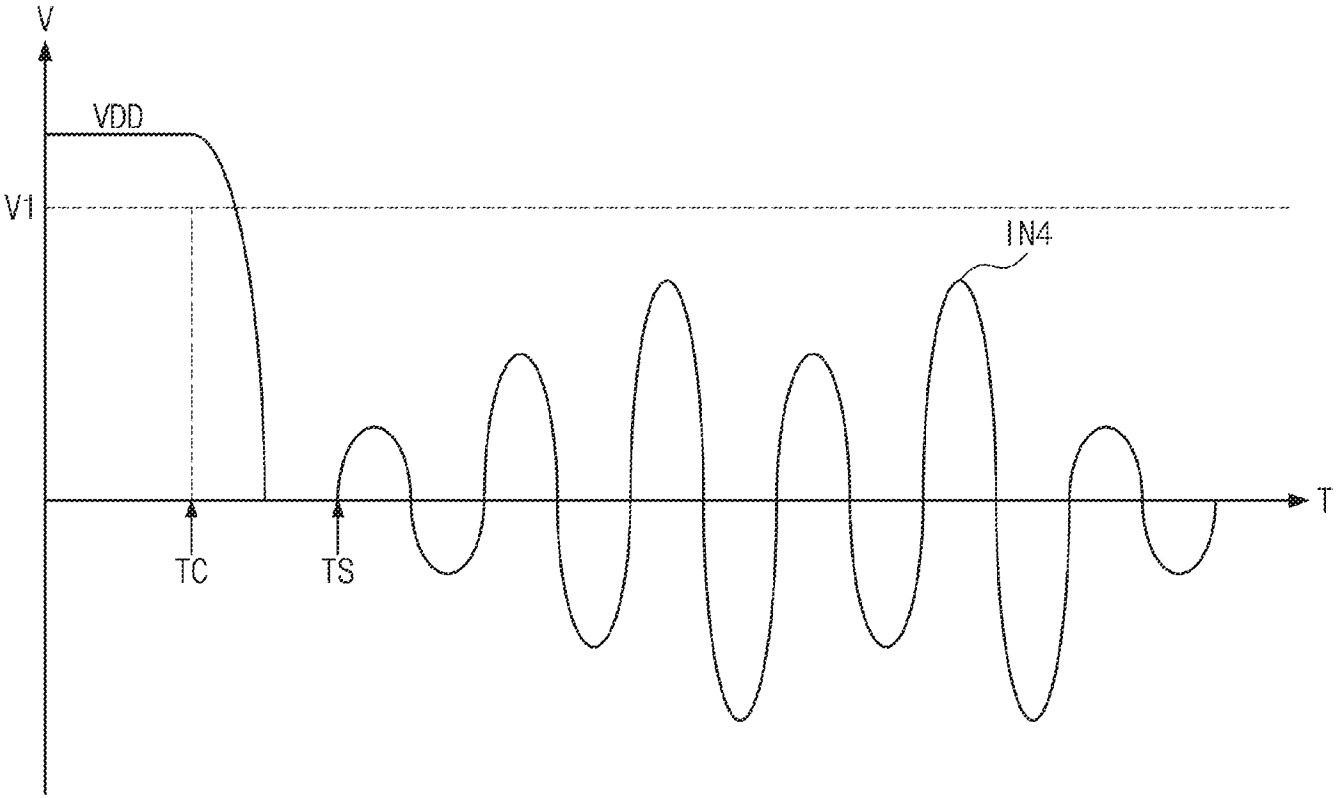
FIG. 6 illustrates an example of voltage variation of a first channel detection electrode when a jack is coupled with a jack slot and an audio codec outputs a fourth input signal shown in FIG. 4.

FIG. 6 illustrates an example of voltage variation of the first channel detection electrode 225 when the jack 400 is coupled with the jack slot 200 and the audio codec 300 outputs the fourth input signal IN4 shown in FIG. 4. In FIG. 6, a horizontal axis denotes time T and a vertical axis denotes a voltage V.

Referring to FIGS. 3, 5, and 6, the first channel detection electrode 225 is floated when the jack 400 is not inserted into the jack slot 200 (e.g., before connection time TC). Thus, the power supply voltage VDD is transmitted to the first channel detection electrode 225 through the first pull-up resistor PUR1 of jack detector 100 as shown in FIG. 5 and a voltage of the first channel detection electrode 225 is the power supply voltage VDD.

The jack 400 may be inserted into the jack slot 200 at a connection time TC, as shown in FIG. 2. At time TC, the first channel detection electrode 225 is connected to the personal reproducing device PD together with the first channel electrode 220, as shown in FIG. 3. In general, the first pull-up resistor PUR1 may have a much greater value (e.g., 1 mega ohm) than the load resistor LR. Thus, a voltage of the first channel detection electrode 225 is dominantly determined by a voltage of the first channel electrode 220. When the output signal OUT indicates that the jack 400 is not inserted, i.e., the output signal OUT is high, the amplifier 350 is disabled. Thus, the voltage of the first channel detection electrode 225 starts dropping toward a ground voltage by a ground node connected to the load resistor LR.

When the voltage of the first channel detection electrode 225 drops to be lower than the first voltage V1, the first comparator CP as shown in FIG. 5 may output a low level. When the ground detection electrode 245 is connected to the third pole 430 of the jack 400, the logic gate circuit OR outputs a low-level output signal OUT. As the output signal OUT transitions to a low level, the amplifier 350 may be enabled.

After the amplifier 350 is enabled, at the start time TS, the audio codec 300 may output the fourth input signal IN4 to the first channel electrode 220. Thus, the voltage of the first channel detection electrode 225 may vary the same as the first input signal IN4, as shown in FIG. 6.

Figure 7:
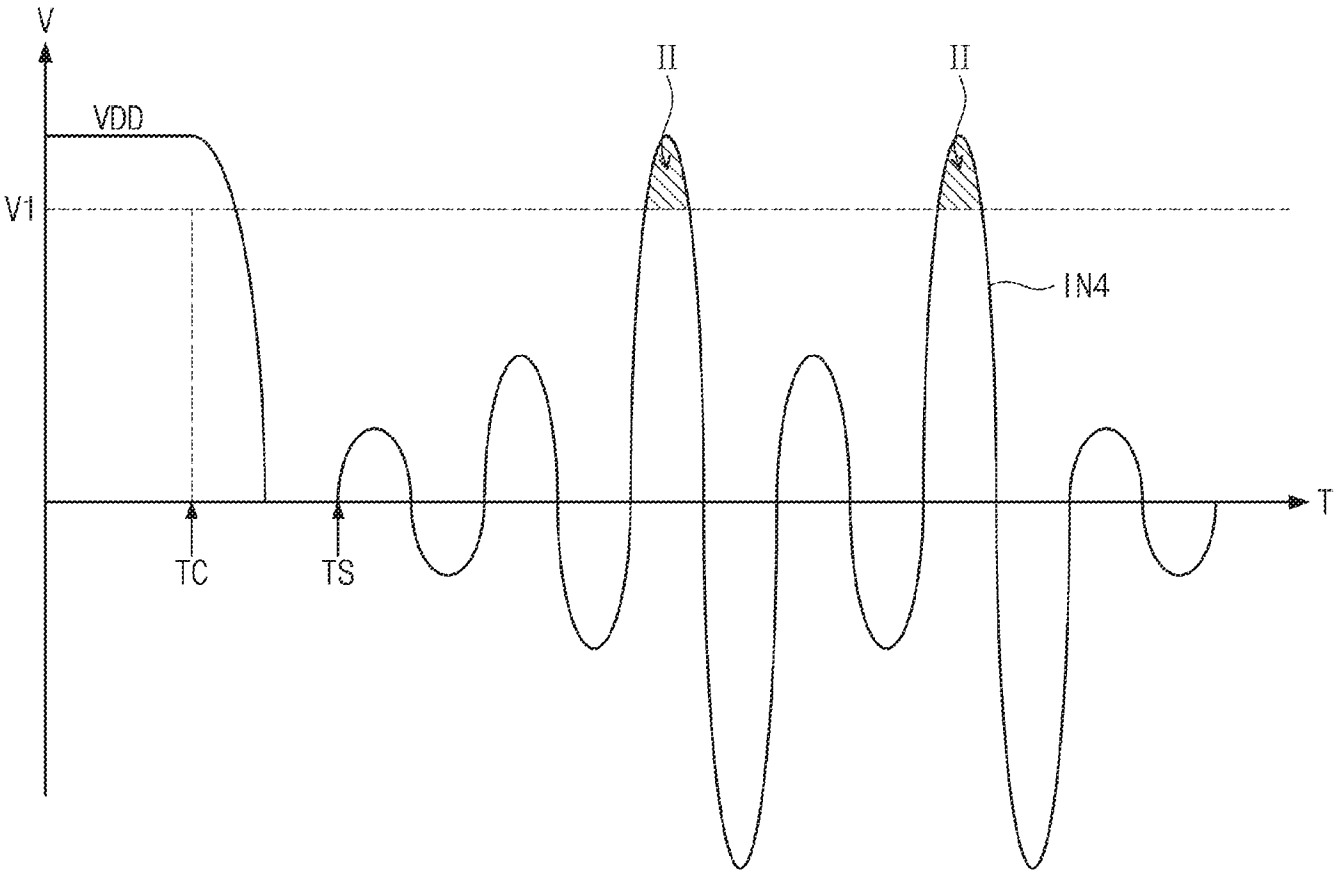
FIG. 7 illustrates an example in which swing width of the fourth input signal increases.

As the need for improved audio quality has increased, methods of increasing swing width of a signal such as the fourth input signal IN4 output from the amplifier 350 have consequently been attempted. FIG. 7 illustrates an example of increasing the swing width of the fourth input signal IN4. In FIG. 7, a horizontal axis denotes time T and a vertical axis denotes a voltage V.

Compared with FIG. 6, as the swing width of the fourth input signal IN4 increases, isolation intervals II occur in which the level of the fourth input signal IN4 is made higher than or equal to that of the first voltage V1. In the isolation intervals II, since the first comparator CP outputs a high level, the logic gate circuit OR outputs a high-level output signal OUT. That is, because of the increased swing width at the isolation intervals II, it is mistakenly determined that the jack 400 is disconnected from the jack slot 200. When the output signal OUT transitions to a high level, the amplifier 350 is disabled and the personal reproducing device PD does not output a sound based on the fourth input signal IN4.

Although the occurrence of the isolation intervals II may be solved by increasing the levels of the power supply voltages VDD and the first voltage V1, an additional charge pump and high-pressure design are required and the cost of the jack detector 100 increases.

Figure 8:
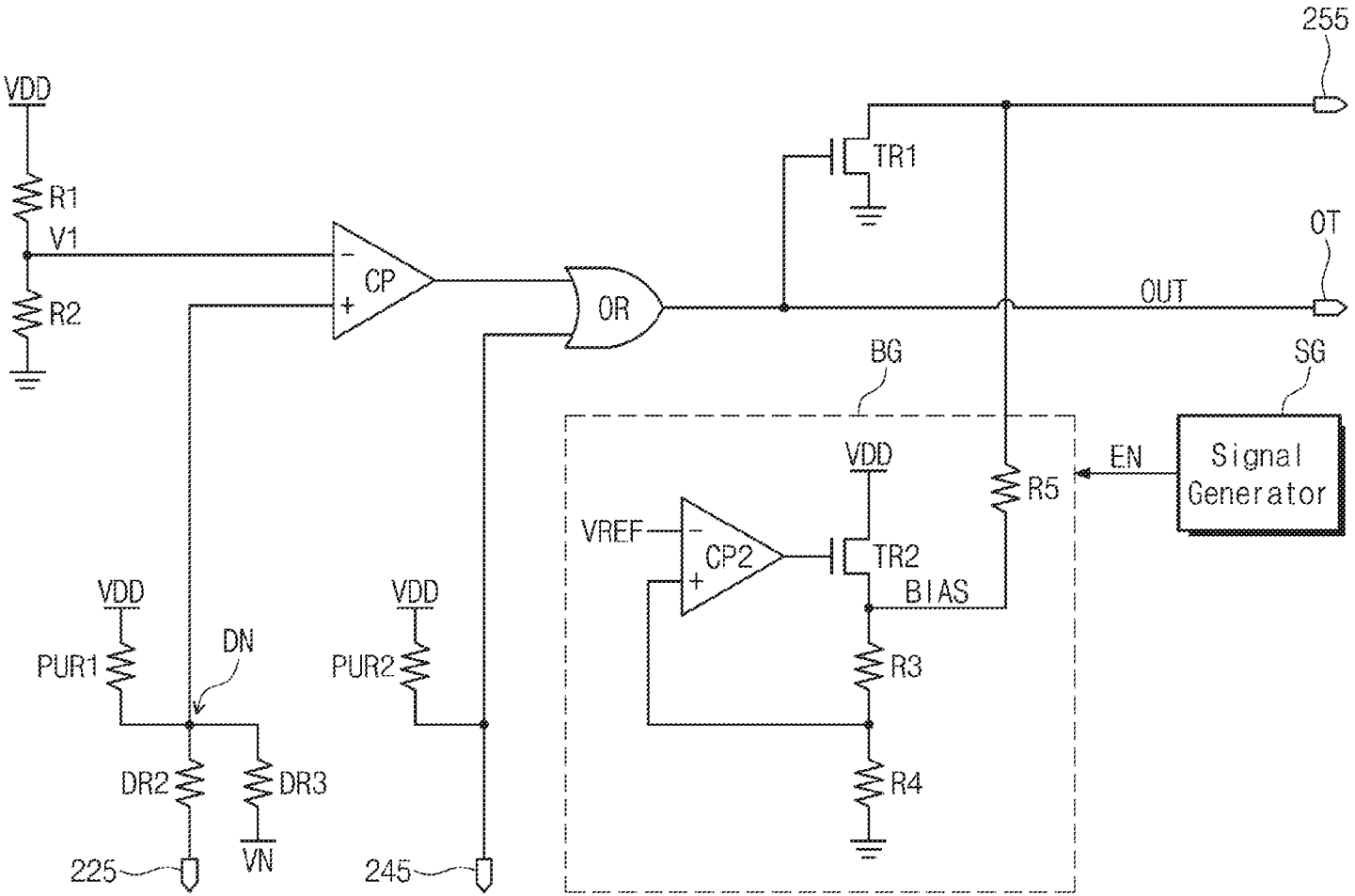
FIG. 8 illustrates an example of a jack detector that prevents occurrence of an isolation interval.

FIG. 8 illustrates an example of a jack detector 100*a* that prevents occurrence of isolation intervals II while maintaining general design of the jack detector 100 shown in FIG. 5. Since the configuration and components of the jack detector

100*a* in FIG. 8 is similar to jack detector 100 in FIG. 5, detailed description of like components and operation in FIG. 8 may be omitted from the following.

Referring to FIGS. 1 and 8, the jack detector 100*a* includes a first resistor R1, a second resistor R2, a comparator CP, a first pull-up resistor PUR1, a second detection resistor DR2, a third detection resistor DR3, a logic gate circuit OR, a second pull-up resistor PUR2, a first transistor TR1, a signal generator SG, and a bias voltage generation circuit BG.

Compared with the jack detector 100 in FIG. 5, the jack detector 100*a* in FIG. 8 further includes the second detection resistor DR2 and the third detector resistor DR3 both connected to a detection node DN to which the first pull-up resistor PUR1 and a positive input of the comparator CP are connected. The second detection resistor DR2 is coupled between the detection node DN and the first channel detection electrode 225. The third detection resistor DR3 is coupled between the detection node DN and a node to which a negative voltage VN is supplied. The negative voltage VN may be output from the second charge pump 340 in FIG. 3.

That is, the first pull-up resistor PUR1 the second detection resistor DR2, and the third detection resistor DR3 may be connected to the positive input of the first comparator CP in a Y-shaped configuration. The center of the Y-shaped configuration is the detection node DN, and a voltage at the detection node DN may be transmitted to the positive input of the first comparator CP. The Y-shaped configuration may be characterized as including the first pull-up resistor PUR1 as connected between the detection node DN and a power supply node to which a power supply voltage VDD is supplied, the second detection resistor DR2 as connected between the detection node DN and the first channel detection electrode 225, and the third detection resistor DR3 connected between the detection node DN and the negative voltage VN.

A resistance of each of the first pull-up resistor PUR1 the second detection resistor DR2, and the third detection resistor DR3 may have a much greater value than the load resistor LR of the personal reproducing device PD shown in FIG. 3. Resistances of the first pull-up resistor PUR1 the second detection resistor DR2, and the third detection resistor DR3 may be different from each other. However, in the following for brevity of description, it will be assumed that the resistances of the first pull-up resistor PUR1 the second detection resistor DR2, and the third detection resistor DR3 are equal to each other. When the resistances of the first pull-up resistor PUR1 the second detection resistor DR2, and the third detection resistor DR3 are equal to each other, a voltage at the detection node DN is one-third of the sum total of the voltage at the first channel detection electrode 225, the power supply voltage VDD, and the negative voltage VN. An example of variation of the voltage at the detection node DN of jack detector 100*a* in FIG. 8 will be described with reference to FIGS. 9 to 13.

Figure 9:
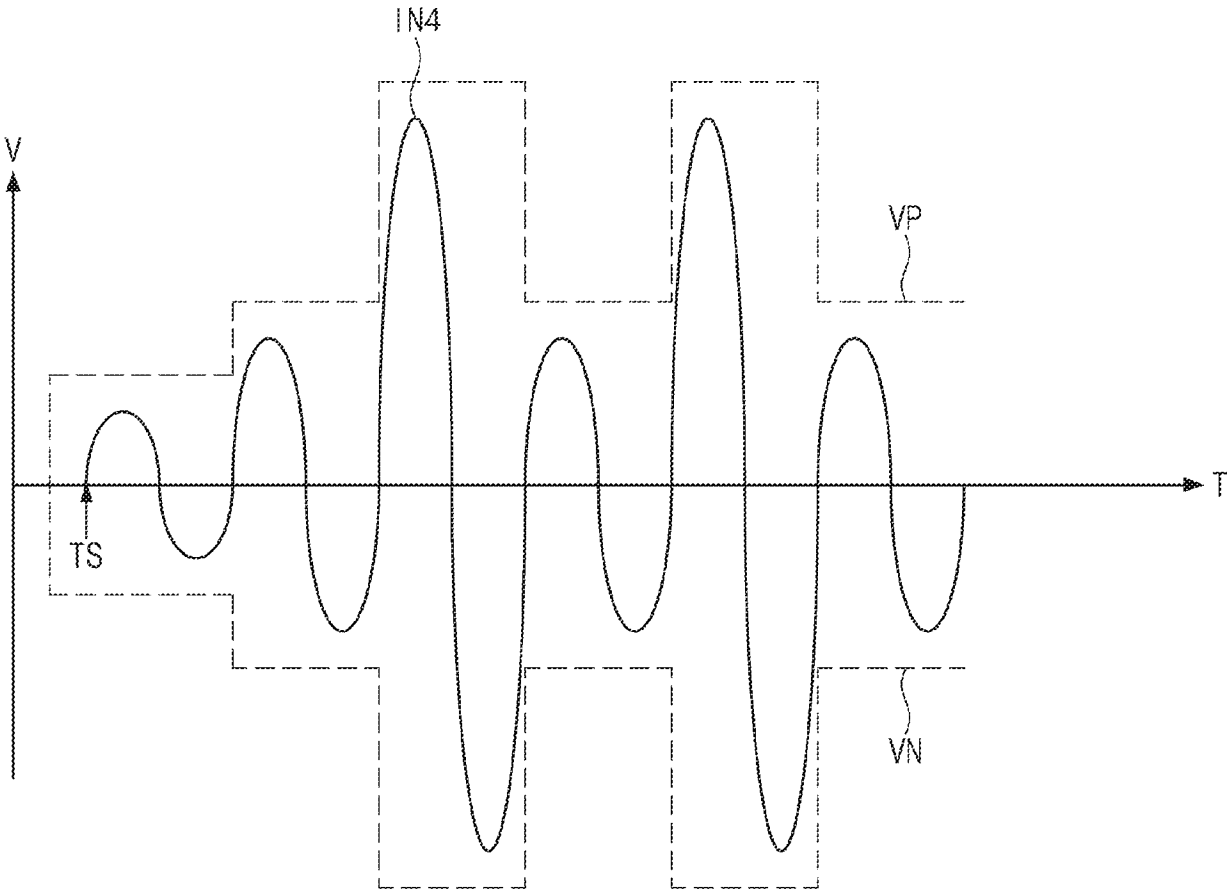
FIG. 9 illustrates an example of the fourth input signal in FIG. 7 and corresponding positive and negative voltages.

FIG. 9 illustrates an example of the fourth input signal IN4 in FIG. 7 and corresponding positive and negative voltages VP and VN. In FIG. 9, a horizontal axis denotes time T and a vertical axis denotes a voltage V.

As described with reference to FIG. 4, the positive voltage VP is controlled to be a level higher than or equal to a maximum level in each interval of the fourth input signal IN4. The negative voltage VN is controlled to be a level lower than or equal to a minimum level of each interval of the fourth input signal IN4.

Figure 10:
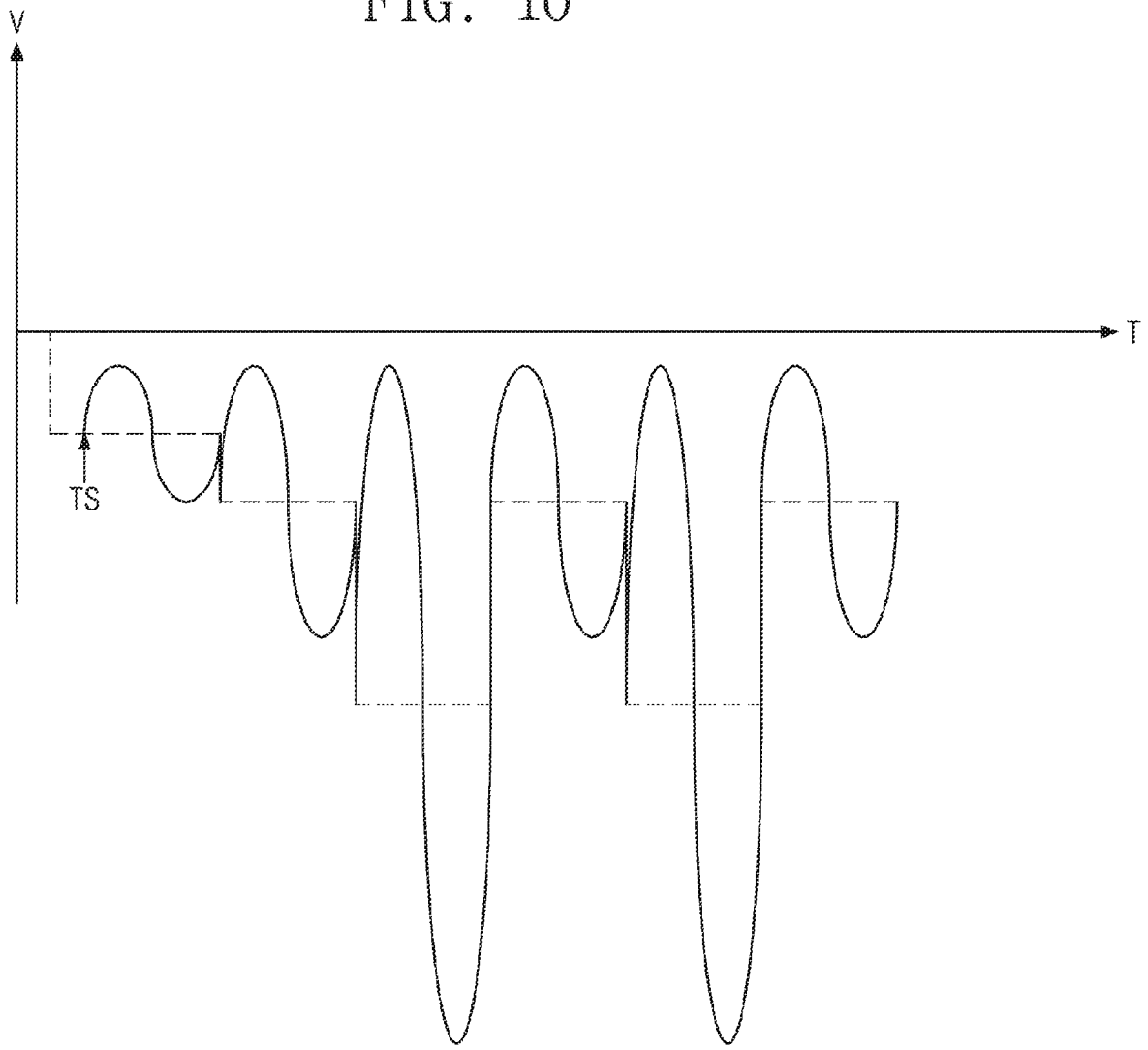
FIG. 10 illustrates an example of the sum of the fourth input signal in FIG. 7 and a corresponding negative voltage.

FIG. 10 illustrates an example of the sum of the fourth input signal IN4 in FIG. 7 and a corresponding negative voltage VN. In FIG. 10, a horizontal axis denotes time T and a vertical axis denotes a voltage V.

Referring to FIG. 10, when the fourth input signal IN4 and the negative voltage VN are summed, it appears that the fourth input signal IN4 swings around the negative voltage VN. As a swing width of the fourth input signal IN4 increases, the negative voltage VN decreases. As the swing width of the fourth input signal IN4 decreases, the negative voltage VN increases. Thus, the sum of the fourth input signal IN4 and the negative voltage VN is maintained at a level lower than a ground level.

Figure 11:
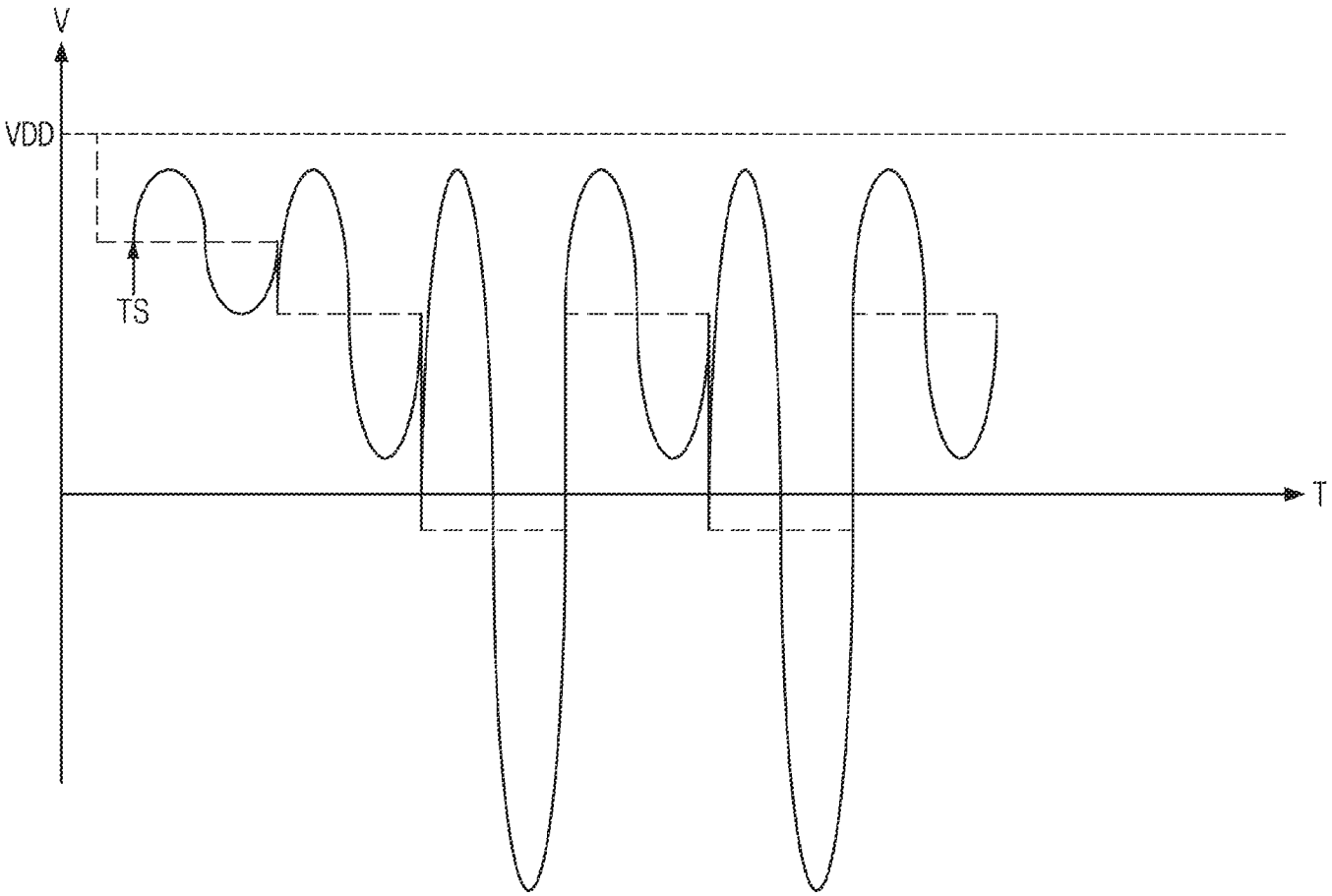
FIG. 11 illustrates an example of the sum of a fourth input signal, a negative voltage, and a power supply voltage.

FIG. 11 illustrates an example of the sum of a fourth input signal IN4, a negative voltage VN, and a power supply voltage VDD. In FIG. 11, a horizontal axis denotes time T and a vertical axis denotes a voltage V.

The sum of the fourth input signal IN4, the negative voltage VN, and the power supply voltage VDD is the sum of the signal in FIG. 10 and the power supply voltage VDD. Accordingly, in FIG. 11, the sum of the fourth input signal IN4, the negative voltage VN, and the power supply voltage VDD appears to be the signal shown in FIG. 10 shifted by the power supply voltage VDD.

Figure 12:
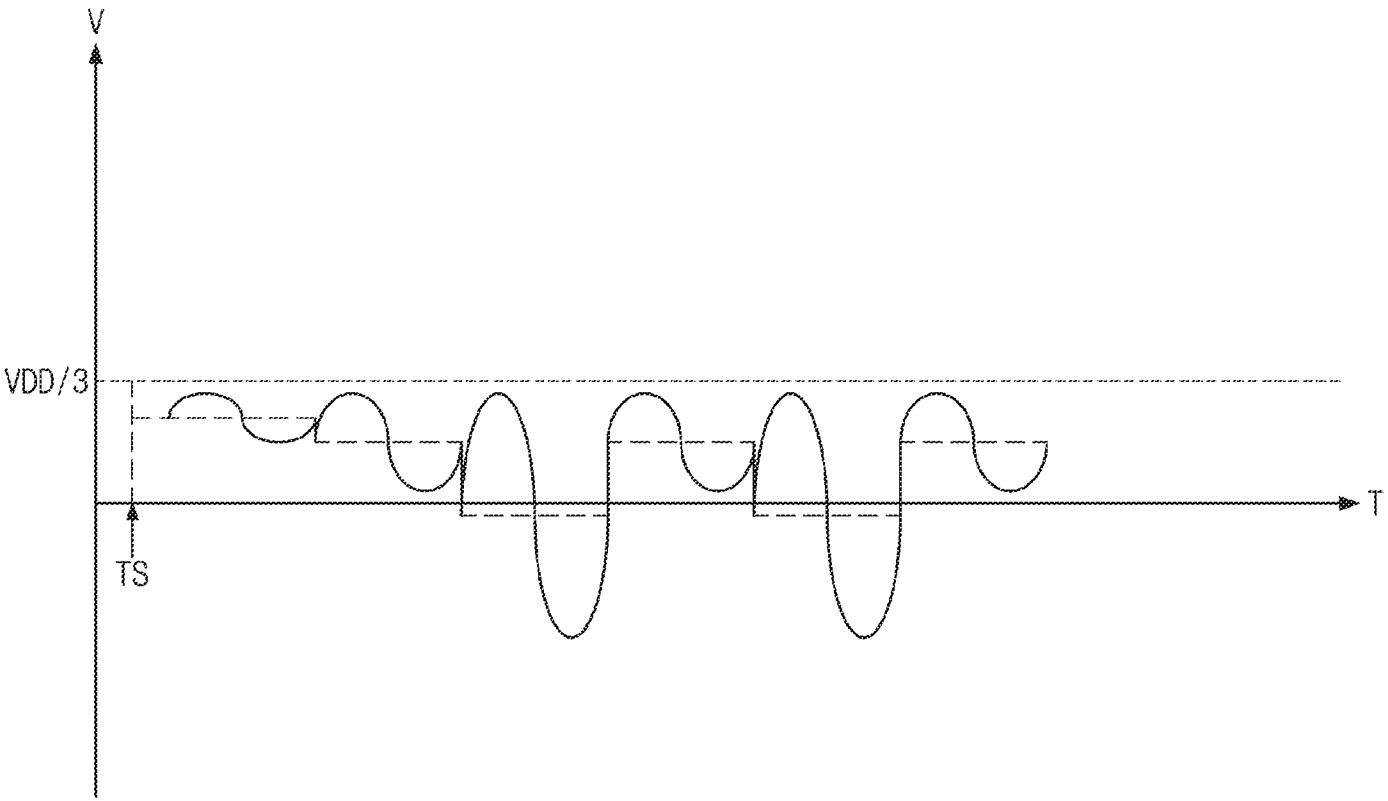
FIG. 12 illustrates an example of the reduced sum of a fourth input signal, a negative voltage, and a power supply voltage.

FIG. 12 illustrates an example of the reduced sum of a fourth input signal IN4, a negative voltage VN, and a power supply voltage VDD. In FIG. 12, a horizontal axis denotes time T and a vertical axis denotes a voltage V. For example, one-third of the sum of the fourth input signal IN4, the negative voltage VN, and the power supply voltage VDD is shown in FIG. 12. In other words, FIG. 12 illustrates the sum of the fourth input signal IN4, the negative voltage VN, and the power supply voltage VDD such as shown in FIG. 11, reduced one-third. Referring to FIG. 12, a voltage is maintained at a level lower than one-third of a level of the power supply voltage VDD.

Figure 13:
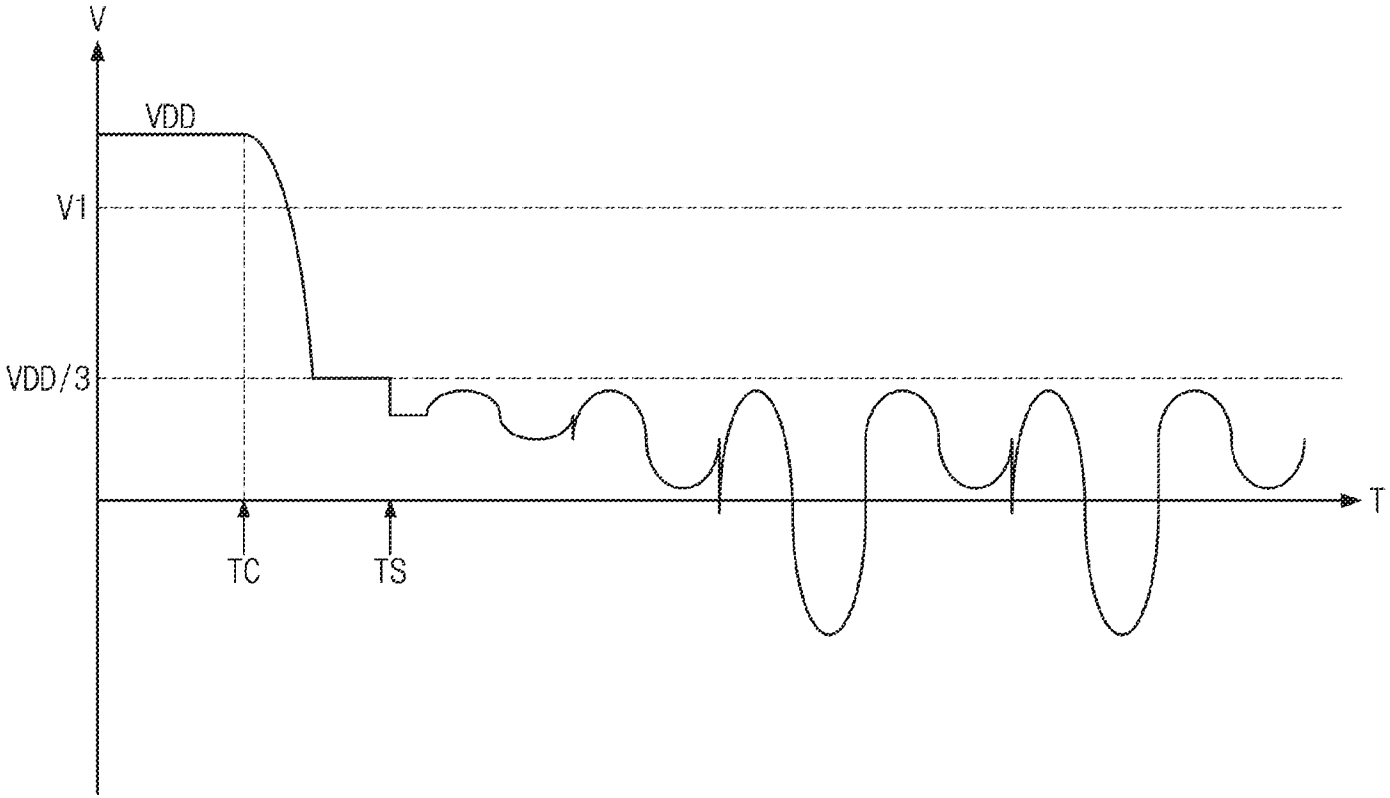
FIG. 13 illustrates an example of variation of a voltage at a detection node.

FIG. 13 illustrates an example of variation of a voltage at a detection node DN of jack detector 100*a* in FIG. 8. Referring to FIGS. 8 and 13, the first channel detection electrode 225 and the negative voltage VN are in a state when the jack 400 is not inserted. Thus, the power supply voltage VDD is transmitted to the detection node DN through the first pull-up resistor PUR1 and the voltage at the detection node DN is a power supply voltage VDD prior to a connection time TC.

At the connection time TC, the jack 400 may be inserted into the jack slot 200. When the jack 400 is inserted, the voltage of the first channel detection electrode 225 is made equal to that of the first channel electrode 220 and the negative voltage VN is supplied. When an audio codec 300 does not output an audio signal for reproduction, the voltage of the first channel electrode 220 and the negative voltage VN may have a ground level. That is, since the voltage of the detection electrode DN is one-third of the sum of the power supply voltage VDD, the negative voltage VN, and the voltage of the first channel detection electrode 225, the voltage of the detection electrode DN is lower than one-third of the power supply voltage VDD.

At the start time TS, the audio codec 300 may output the fourth input signal IN4 shown in FIG. 7. However, unlike as shown in FIG. 7, the voltage of the detection electrode DN appears as shown in FIG. 12 and is maintained at a level lower than one-third of the level of the power supply voltage VDD. That is, a level of a voltage at the detection node DN is maintained at a level that is lower than a predetermined fraction of the power supply voltage VDD. Thus, unlike as shown in FIG. 7, isolation intervals II do not occur.

As described above, the first channel detection electrode 225, the power supply voltage VDD, and the negative voltage VN of jack detector 100*a* are connected in the Y-shaped configuration and the voltage of the detection node DN that is the center of the Y-shaped configuration is used to determine whether the jack 400 is inserted. Thus, the detector 100*a* is prevented from mistakenly detecting the jack 400 as being disconnected when the fourth input signal IN4 output through the first channel electrode 220 includes increased swing width. As a result, reliability of the jack detector 100*a* is enhanced.

The voltage of the detection electrode DN is maintained at a level lower than a specific level according to resistances of the first pull-up resistor PUR1, the second detection resistor DR2, and the third detection resistor DR3 that form the Y-shaped configuration. Thus, the levels of the first voltage V1 and the power supply voltage VDD used as a comparison target of the first comparator CP1 may be further lowered without causing a malfunction of the jack detector 100*a*. When the levels of the first voltage V1 and the power supply voltage VDD are lowered, power consumption of the jack detector 100*a* may be reduced.

For brevity of description, it has been assumed that the resistances of the first pull-up resistor PUR1, the second detection resistor DR2, and the third detection resistor DR3 are equal to each other. However, the resistances of the first pull-up resistor PUR1, the second detection resistor DR2, and the third detection resistor DR3 may be different from each other.

Additionally, it has been assumed that the negative voltage VN varies through estimation (or prediction) of the swing width of the fourth input signal IN4. However, other embodiments of the inventive concept the negative voltage VN does not vary and may be fixed through estimation (or prediction) of the swing width of the fourth input signal IN4.

In other embodiments of the inventive concept, instead of using the negative voltage VN of the amplifier 350 as the negative voltage VN in the jack detector 100*a* of FIG. 8, another negative voltage, e.g., a fixed or variable negative voltage may be applied to the third detection resistor DR3 of the jack detector 100*a*.

As described above, a jack detector is provided whereby a voltage at a detection node of the jack detector is controlled so as not to be higher than a reference voltage of a comparator. Thus, the jack detector is prevented from mistakenly detecting a jack as being disconnected from a jack slot, and reliability of the jack detector is enhanced.

The above-disclosed subject matter is to be considered illustrative, and not restrictive, and the appended claims are intended to cover all such modifications, enhancements, and other features, which fall within the true spirit and scope of inventive concepts. Thus, to the maximum extent allowed by law, the scope of inventive concepts is to be determined by the broadest permissible interpretation of the following claims and their equivalents, and shall not be restricted or limited by the foregoing detailed description. While some example embodiments have been particularly shown and described, it will be understood by one of ordinary skill in the art that variations in form and detail may be made therein without departing from the spirit and scope of the claims.

What is claimed is:

1. An audio device comprising:

a channel detection electrode; and a jack detector configured to determine whether the channel detection electrode is in contact with a jack according to a voltage variation at a detection node, and to provide an output signal indicative of the determination, wherein the jack detector comprises a first resistor coupled between the detection node and a first node to which a power supply voltage is supplied, a second resistor coupled between the detection node and the channel detection electrode, a third resistor coupled between the detection node and a second node, wherein a level of a detecting voltage at the detection node is lower than a predetermined fraction of a level of the power supply voltage, and a comparator configured to compare the detection voltage at the detection node with a reference voltage to provide the output signal.

2. The audio device of claim 1, wherein the jack detector is configured to maintain the second node in a floating state before the channel detection electrode comes in contact with the jack.

3. The audio device of claim 1, wherein the jack detector is configured to supply the second node with a negative voltage after the channel detection electrode comes in contact with the jack.

4. The audio device of claim 1, further comprising:

a ground detection electrode, wherein the jack detector is configured to determine whether the ground detection electrode is in contact with the jack according to a voltage variation of the ground detection electrode.

5. The audio device of claim 4, wherein the jack detector is configured to maintain the second node in a floating state before the channel detection electrode and the ground detection electrode come in contact with the jack.

6. The audio device of claim 4, wherein the jack detector is configured to supply the second node with a negative voltage after the channel detection electrode and the ground detection electrode come in contact with the jack.

7. An audio device comprising:

an audio codec circuit connected to a first channel electrode and a second channel electrode; and a jack detector connected to a first channel detection electrode and a ground detection electrode, wherein the jack detector is configured to determine whether the first channel detection electrode is in contact with a jack according to a voltage variation of a detection node, and to provide an output signal indicative of the determination, and wherein the jack detector comprises a first resistor coupled between the detection node and a first node to which a power supply voltage is supplied, a second resistor coupled between the detection node and the first channel detection electrode, a third resistor coupled between the detection node and a second node, wherein a level of a detecting voltage at the detection node is lower than a predetermined fraction of a level of the power supply voltage, and a comparator configured to compare the detection voltage at the detection node with a reference voltage to provide the output signal.

8. The audio device of claim 7, wherein the audio codec circuit comprises an amplifier configured to output a first channel signal to the first channel electrode, and wherein the amplifier is configured to be biased by a positive voltage and a negative voltage, and the negative voltage is supplied to the second node.

9. The audio device of claim 8, wherein the audio codec circuit is configured to adjust the negative voltage according to a swing width of the first channel signal.

10. The audio device of claim 8, wherein the jack detector is configured to enable the output signal when the first channel detection electrode and the ground detection electrode are in contact with the jack and to transmit the output signal to the audio codec circuit.

11. The audio device of claim 10, wherein the audio codec circuit is configured to switch the negative voltage to a floating state when the output signal is in a disabled state.

12. The audio device of claim 10, wherein the audio codec circuit further comprises:

a first charge pump configured to transmit the positive voltage to the amplifier when the output signal is enabled; and a second charge pump configured to transmit the negative voltage to the amplifier when the output signal is enabled.

13. An audio device comprising:

a jack slot comprising a channel detection electrode; and a jack detector configured to determine whether a jack is inserted into the jack slot, wherein the jack detector is configured to provide a detection voltage at a detection node responsive to a power supply voltage, a negative voltage and a voltage at the channel detection electrode, a level of the detection voltage is lower than a predetermined fraction of a level of the power supply voltage, and wherein the jack detector comprises a comparator configured to compare the detection voltage with a reference voltage and to provide an output signal indicative of whether the jack is inserted into the jack slot responsive to the comparison.

14. The audio device of claim 13, wherein the jack detector further comprises:

a first resistor coupled between the detection node and a first node at which the power supply voltage is supplied;

a second resistor coupled between the detection node and the channel detection electrode; and a third resistor coupled between the detection node and a second node at which the negative voltage is supplied.

15. The audio device of claim 14, wherein a resistance of the first resistor, a resistance of the second resistor and a resistance of the third resistor are substantially the same, and the level of the detection voltage is less than one-third the level of the power supply voltage.

16. The audio device of claim 13, further comprising:

an audio codec circuit connected to a channel electrode of the jack slot, wherein the audio codec circuit comprises an amplifier configured to output a channel signal to the channel electrode, and wherein the amplifier is configured to be biased by a positive voltage and the negative voltage.

17. The audio device of claim 16, wherein the audio codec circuit further comprises:

a first charge pump configured to transmit the positive voltage to the amplifier when the output signal is enabled; and a second charge pump configured to transmit the negative voltage to the amplifier when the output signal is enabled.

* * * * *